US010001351B2

(12) United States Patent
Secco et al.

(10) Patent No.: US 10,001,351 B2
(45) Date of Patent: Jun. 19, 2018

(54) DECOY CARTRIDGE FOR AIRCRAFT

(71) Applicant: Etienne Lacroix Tous Artifices S.A., Muret (FR)

(72) Inventors: Thierry Secco, Saverdun (FR); Cyril Leoquet, Toulouse (FR); Marc Pignol, Plaisance du Touch (FR)

(73) Assignee: ETIENNE LACROIX TOUS ARTIFICES S.A., Muret (FR)

( * ) Notice: Subject to any disclaimer, the term of this patent is extended or adjusted under 35 U.S.C. 154(b) by 0 days. days.

(21) Appl. No.: 15/123,227

(22) PCT Filed: Mar. 2, 2015

(86) PCT No.: PCT/EP2015/054329

§ 371 (c)(1),
(2) Date: Sep. 1, 2016

(87) PCT Pub. No.: WO2015/132212

PCT Pub. Date: Sep. 11, 2015

(65) Prior Publication Data

US 2017/0074626 A1 Mar. 16, 2017

(30) Foreign Application Priority Data

Mar. 3, 2014 (FR) ..... 14 51687

(51) Int. Cl.
*F42B 3/26* (2006.01)
*F42B 4/26* (2006.01)
(Continued)

(52) U.S. Cl.
CPC ..... *F42B 4/26* (2013.01); *F41J 2/02* (2013.01); *F42B 5/15* (2013.01); *F42B 12/70* (2013.01)

(58) Field of Classification Search
CPC ..... F42B 4/26; F42B 5/15; F42B 12/70
(Continued)

(56) References Cited

U.S. PATENT DOCUMENTS

RE8,167 E * 4/1878 Very ..... 102/342
2,436,751 A * 2/1948 Hammell ..... F42B 12/42 102/342
(Continued)

FOREIGN PATENT DOCUMENTS

DE 34 43 778 A1 5/1988
DE 100 65 816 A1 7/2002
(Continued)

OTHER PUBLICATIONS

Search Report in PCT/EP2015/054329 dated Jun. 15, 2015, with English translation coversheet. 3 pages.
(Continued)

*Primary Examiner* — Joshua E Freeman
(74) *Attorney, Agent, or Firm* — Womble Bond Dickinson (US) LLP

(57) ABSTRACT

The present invention relates to a device forming an infrared decoy comprising a pyrotechnic priming part (150), a composition (121) suited to emitting radiation in the infrared domain, and a protective casing (130) for protecting the composition (121) and formed of a plastic sleeve, characterized in that at least one out of a body (150) of the initiation pyrotechnic part and/or of a plug (140) that blanks off the sleeve (130) has an annular groove (152, 142) that opens onto its external periphery and communicates with at least one longitudinal duct (154, 156; 144, 146) which opens onto an end of the body (150) or of the plug (140) in order to accept a polymerizable adhesive tape that bonds the body (150) and/or the plug (140) to the sleeve (130).

12 Claims, 5 Drawing Sheets

Figure 1:
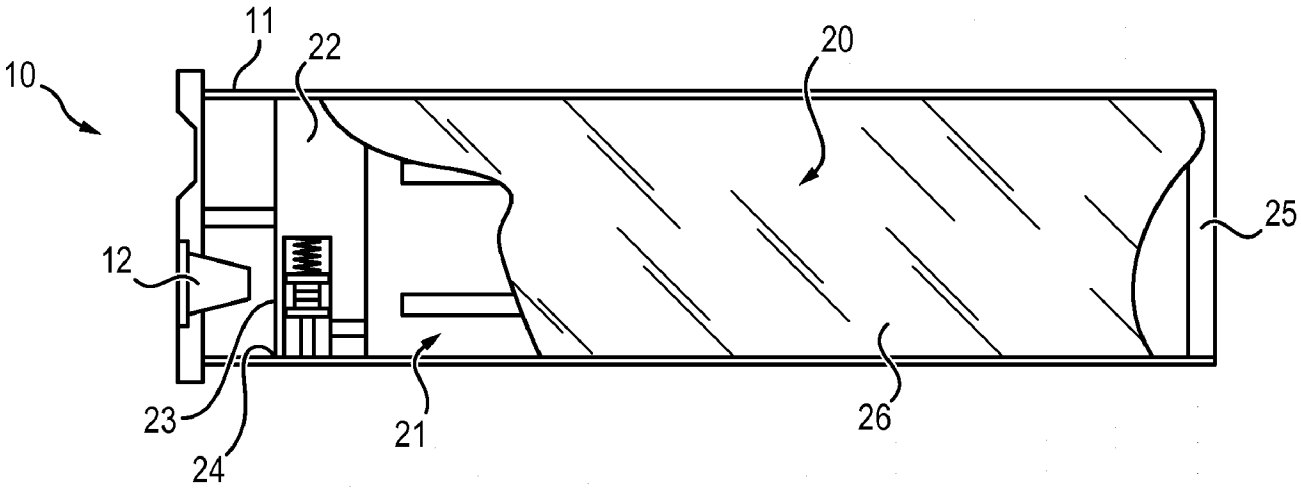
FIG. 1 Prior art

(51) Int. Cl.
*F41J 2/02* (2006.01)
*F42B 5/15* (2006.01)
*F42B 12/70* (2006.01)

(58) Field of Classification Search
USPC ..... 102/342, 336, 343, 341, 345
See application file for complete search history.

(56) References Cited

U.S. PATENT DOCUMENTS 2,868,129 A * 1/1959 Johnson ..... F42B 4/26 102/513
3,399,621 A * 9/1968 Schillreff ..... F21L 17/00 102/341
3,596,599 A * 8/1971 Schillreff ..... F42C 15/18 102/200
3,901,152 A 8/1975 Alexander
4,171,669 A * 10/1979 Allen ..... F41J 2/02 102/342
4,454,816 A * 6/1984 Billard ..... F42C 15/184 102/223
4,458,597 A * 7/1984 Reynes ..... F42B 10/02 102/223
4,624,186 A * 11/1986 Widera ..... F42B 4/26 102/334
4,791,870 A * 12/1988 Simpson ..... C06B 39/00 102/342
5,561,259 A * 10/1996 Herbage ..... F42B 5/08 102/251
5,763,818 A * 6/1998 Guymon ..... F42B 4/26 102/249
6,170,399 B1 * 1/2001 Nielson ..... C06B 21/0075 102/275.4
6,634,301 B1 * 10/2003 Mulinix ..... F42B 4/26 102/229
7,421,950 B2 * 9/2008 Dillard ..... F41J 2/02 102/342
7,469,640 B2 * 12/2008 Nielson ..... C06B 45/12 102/289
7,640,858 B1 * 1/2010 Herbage ..... C06B 21/0041 102/336
7,992,496 B2 * 8/2011 Dillard ..... F41J 2/02 102/336
2004/0011235 A1 * 1/2004 Callaway ..... F41J 2/02 102/336
2008/0134926 A1 * 6/2008 Nielson ..... C06B 45/12 102/336
2013/0112099 A1 * 5/2013 Widener ..... F42B 4/26 102/336
2015/0259262 A1 * 9/2015 Nielson ..... F41J 2/02 102/336
2015/0323296 A1 * 11/2015 Rastegar ..... F42B 4/26 102/342
2016/0107949 A1 * 4/2016 Nielson ..... C06B 27/00 102/336
2017/0074626 A1 * 3/2017 Secco ..... F42B 4/26

FOREIGN PATENT DOCUMENTS

GB 2 300 035 A 10/1996
WO WO 02/48641 A1 6/2002
WO WO 2007/002378 A2 1/2007

OTHER PUBLICATIONS

Search Report in French Application No. 1451687 dated Nov. 27, 2014, with English translation coversheet. 3 pages.

* cited by examiner

DECOY CARTRIDGE FOR AIRCRAFT

The present invention relates to the field of decoys particularly for protecting aircraft such as airplanes and/or helicopters.

Different devices intended to form decoys, particularly in the infrared field, have already been proposed. Examples of known devices will be found in documents GB 2 300 035, DE 100 65 816 DE 34 43 778 and U.S. Pat. No. 2,868,129.

The aforementioned documents describe systems comprising a sheath made of plastic material which accommodates a charge intended to form a decoy. The means described in the aforementioned documents based on a sheath made of plastic to contain the charge have however generally been abandoned recently in favor of a very different charge confinement solution based on a film, usually made of aluminium, coiled over the charge. As will be seen later, the use of a film of aluminium coiled over the charge has in fact been considered to offer advantages.

Thus in all the architectures of aerial decoy cartridges of different calibers and shapes (round, square, rectangular), intended to equip and protect airplanes and helicopters against infrared homing missiles, what is found today is an adhesive envelope made of raster or aluminium paper, folded and surrounding a radiation body (compressed infrared pyrotechnic composition called also an "infrared block") contributing to the ignition and heating thereof.

The present invention has as its object to improve the known devices of the type illustrated in the appended FIG. 1.

Decoy devices emitting infrared radiation have been proposed and used to this effect for many years in accordance with the appended FIG. 1.

Noted in FIG. 1 is a cartridge comprising two main portions: an assembly 10 comprising a casing 11 and an impeller 12, on the one hand, and an assembly 20 intended to be ejected, on the other hand.

The assembly formed from the casing 11 and the impeller 12 is designed to be integral with a loader which is itself integrated in a launcher.

The assembly 10 remains in the loader after firing.

The ejected assembly 20 comprises:

- an assembly 21 forming a radiation body (infrared block),
- an assembly 22 forming the pyrotechnic portion equipped with an ignition charge 23 and a safety slide 24 integrating an arming sleeve providing for interruption of the pyrotechnic chain as long as the ejected assembly 20 has not left the casing 11.
- a closing cover 25 placed at the front of the infrared block 21, and
- an adhesive envelope 26 made of raster paper or aluminium folded to surround the infrared block 21 and also provide a sealed mechanical connection with the pyrotechnic portion assembly 22 and the closing cover 25.

The device shown in FIG. 1 operates as follows:

Firing the impeller 12 drives the ejection of the ejected assembly 20 out of the casing 11 and the initiation of the ignition charge 23 of the pyrotechnic portion assembly 22.

Once the ejected assembly 20 has left the casing 11 completely, the safety slide 24 is released (there is no longer an interruption is the pyrotechnic chain) and thus the ignition charge 23 can initiate the infrared block 21.

The adhesive envelope 26 made of raster or aluminium paper confines the block 21 to provide for heating and pressurization of the infrared block 21.

The adhesive envelope 26 made of raster or aluminium paper is torn or ruptures at the end of the heating period.

The radiation body 21 can thus radiate and emit an infrared signature simulating that of airplanes or helicopters.

The use of an envelope 26 formed of aluminium paper makes it possible to adapt the distribution of the envelope over the radiation body, for example by locally accumulating several layers of paper if desired to modulate the confinement of the radiation body and thus allow good reproducibility of the radiation curves desired.

Moreover, it has been noted that the realization of the envelope 26 made of aluminium paper allows easy tearing during implementation, to leave the radiation body visible.

However, until now it has proven necessary to proceed manually with the coiling of the aluminium paper forming the envelope over the radiation body, due on the one hand to the nature of the radiation body in question, to avoid any danger of untimely ignition during manufacture, and on the other hand to ensure perfect application of the envelope on the entire surface of the radiation body so as to avoid initiation through the outside of the radiation body even with the slide 24 still in its safety position.

As a result, the slightest tear during manufacture in the envelope 26 is likely to lead to ignition of the radiation body, from the outside, through such a tear, even if the assembly 20 which is to be ejected is still in the casing 11, with the slide 24 in its safety position.

Manual coiling of the aluminium paper allows a visual check of the quality of the coiling.

It is not possible, however, to completely exclude the risk of tearing of the envelope when the assembly 20 is introduced into the casing 11.

In this context, the present invention has as its particular objective

- to improve control of the reproducibility of the heating of the slab,
- to improve the robustness of the design in terms of safety, and
- to reduce significantly the cost of production.

These goals are attained according to the invention thanks to a device forming an infrared decoy comprising:

- a triggering pyrotechnic portion,
- a composition adapted to emit radiation in the infrared range, and
- an envelope for protecting the composition, formed from a sheath made of plastic material, characterized in that one at least of a body of the pyrotechnic initiation portion and/or a plug for blocking the sheath has an annular recess which leads to its outer periphery and which communicates with at least one longitudinal channel which leads to one end of the body or the plug to receive a ribbon of polymerizable glue providing for gluing the body and/or the plug of the sheath.

The envelope is preferably a rigid profiled envelope formed by extrusion.

Figure 2:
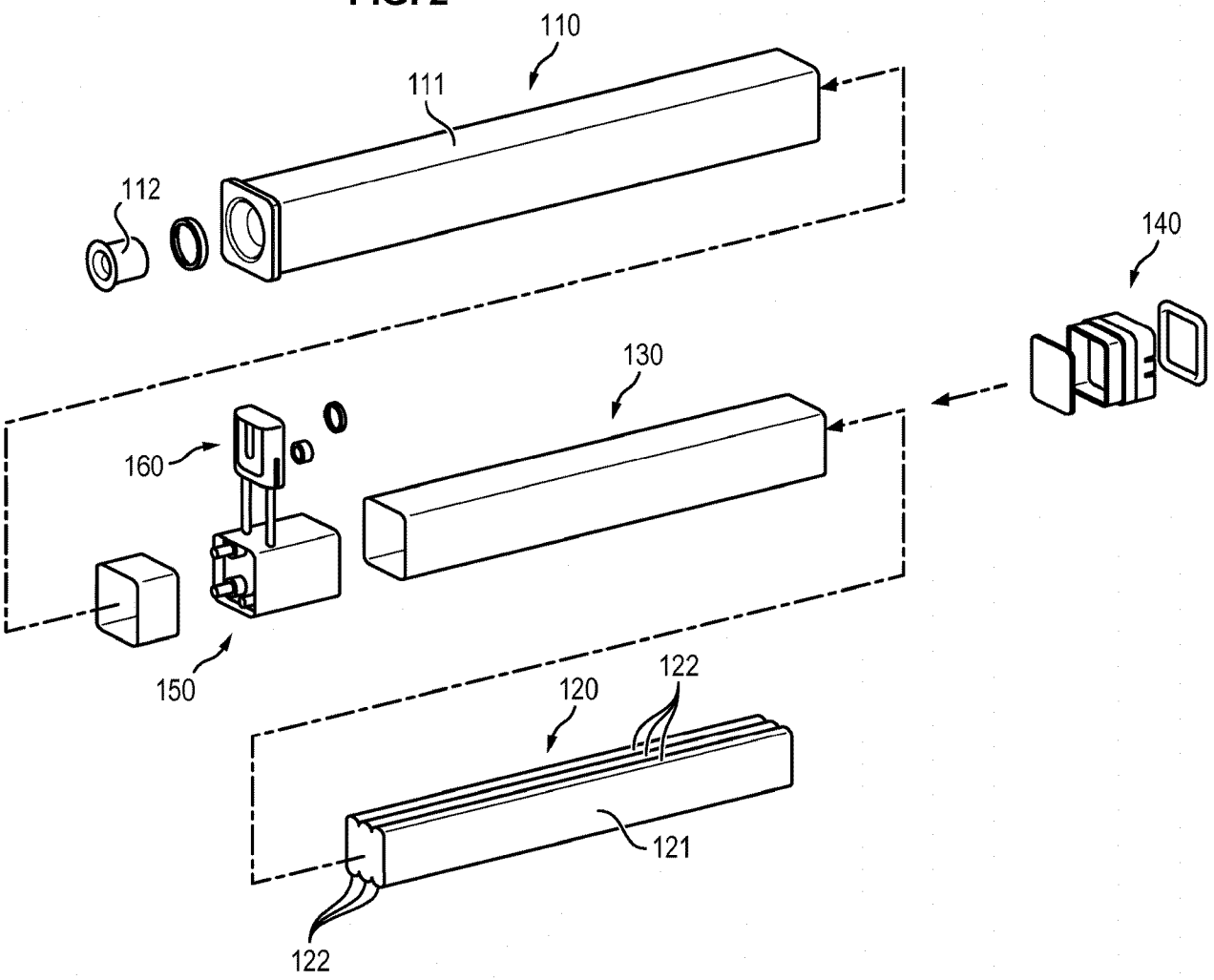
Figure 3:
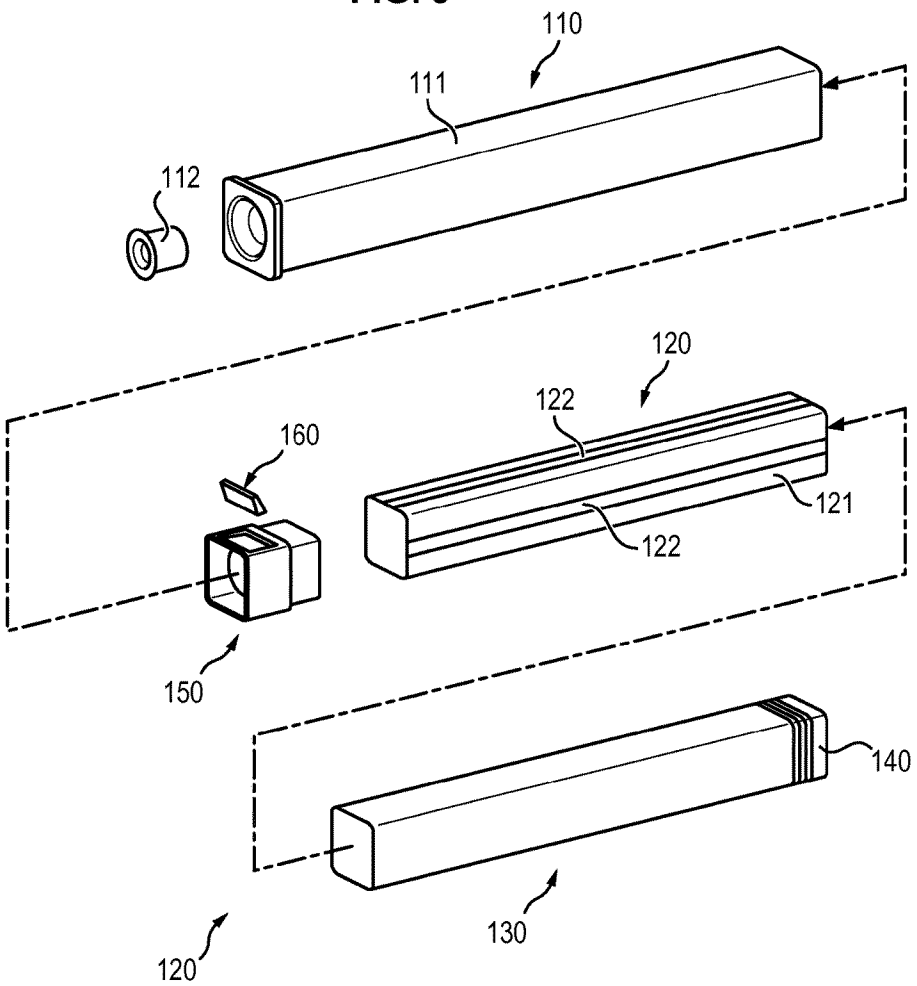
Figure 4:
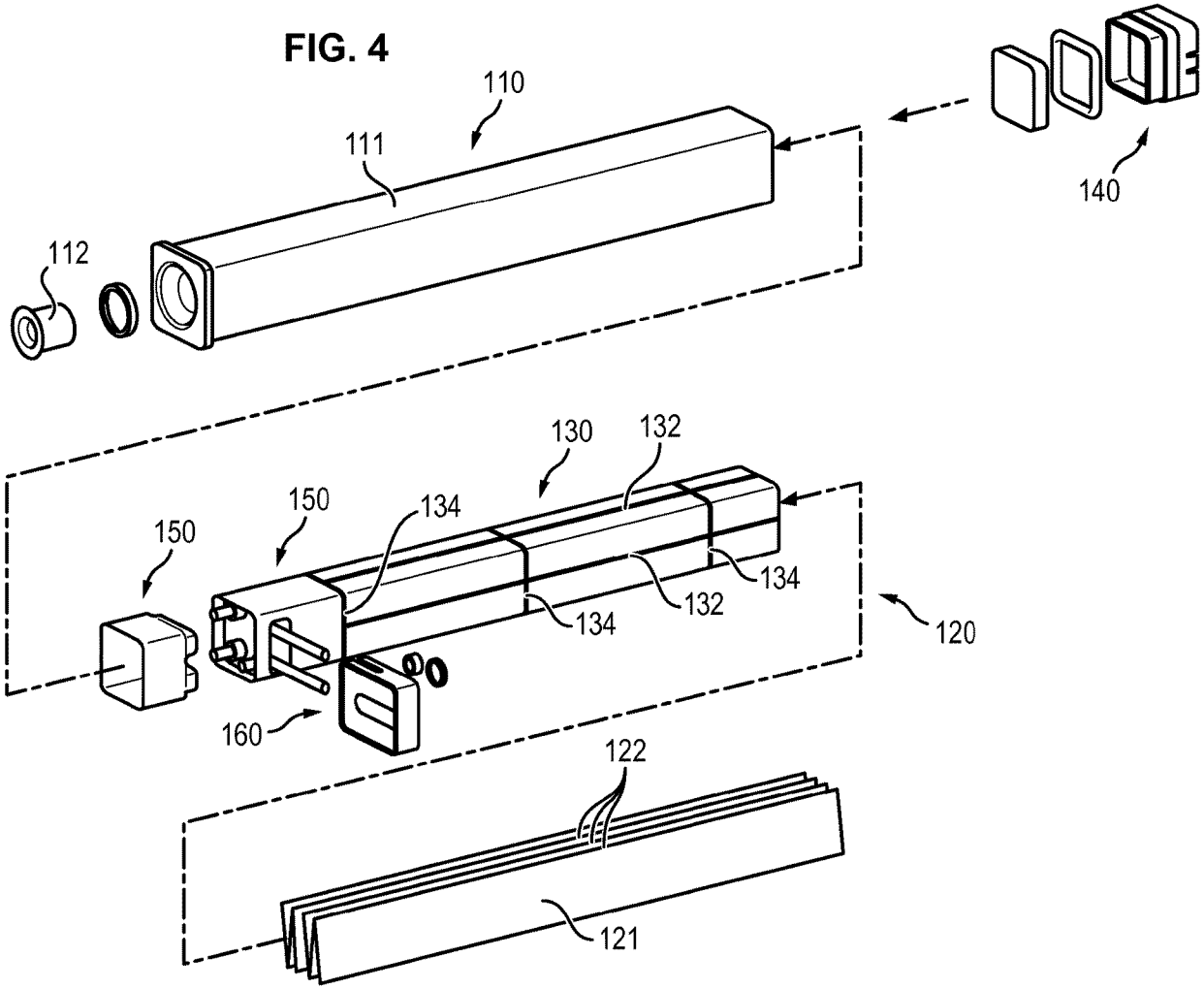
Figure 5:
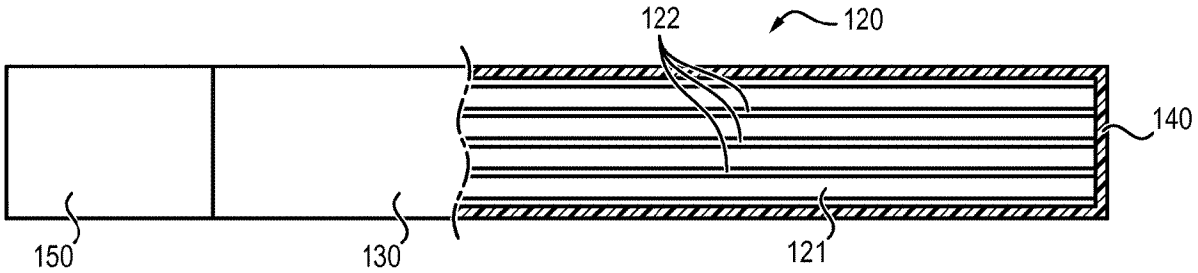

Other features, aims and advantages of the present invention will appear upon reading the detailed description that follows and with reference to the appended drawings given by way of non-limiting examples and wherein:

FIG. 1 shows an exploded section view of a device conforming to the prior art, FIG. 2 shows a general view in perspective prior to assembly of a first embodiment conforming to the present invention, FIG. 3 shows a similar general view in perspective prior to assembly of a second embodiment conforming to the present invention, FIG. 4 shows a similar general view in perspective before assembly of a third embodiment conforming to the present invention, FIG. 5 shows a variant embodiment conforming to the present invention according to which the closure plug is integrated with the envelope made of plastic material, and FIGS. 6, 7, 8 and 9 show respectively a perspective view and a longitudinal section view of body of the pyrotechnic initiation portion of the pyrotechnic initiation portion and a perspective view and a longitudinal section view of a plug conforming to the invention, adapted to facilitate the gluing of said body of the pyrotechnic portion and plug to a sheath.

Observable in FIG. 2 is a device forming a decoy which comprises an assembly 110 comprising a casing 111 associated with an impeller 112 and a portion 120 intended to be ejected.

The casing 111 equipped with the impeller 112, preferably formed from an electrical initiator, is adapted to be placed/cooperate with a launcher. Its structure is conventional in itself and will therefore not be described in more detail hereafter.

The portion 120 intended to be ejected comprises a slab 121 of composition adapted to emit infrared radiation during its combustion.

The slab 121 is placed in a sheath made of plastic material 130 conforming to the invention.

The sheath 130 is preferably formed from a tube with a straight constant section the side wall whereof is continuous, solid, free of openings other than its axial through ends.

This sheath 130 is blocked at the front by a plug 140 and at the back by an pyrotechnic initiation portion 150. This preferably includes a safety slide 160 capable of occupying two positions: on the one hand, a safety position as long as the assembly 120 is accommodated in the casing 111, and on the other hand a release position when the assembly 120 has left the casing 111.

In the safety position the slide 160 is loaded elastically by pressing against the inner wall of the casing 111. Not being able to move transversely to the longitudinal axis of the assembly 120 due to its pressing against the inner surface of the casing 111, it provides for an interruption in the transmission channel of initiation between the impeller 112 and the body of the slab 121.

On the other hand, when the assembly 120 is ejected out of the casing by propulsion gases produced by the impeller 112, the slide 160 no longer having any facing support is displaced (as shown schematically in FIG. 2) and then allows transmission of initiation to the slab 121.

Once the slab 121 is placed in the sheath 130, it is glued on the one hand to the pyrotechnic portion 150 and on the other hand to the closure plug 140. The slab 121 is then perfectly confined and with complete safety all risk of untimely ignition from the outside of the slab 121 is avoided.

It will be noted that the present invention makes it possible to dispense with manual coiling of the aluminium sheet and consequently allows an automated and industrially producible assembly method, particularly for the insertion of the slab 121 into the casing 111 and the gluing of the sheath 130 on the pyrotechnic portion 150 and on the plug 140.

The operation of the device in conformity with the invention remains identical overall to that of the earlier device illustrated in FIG. 1.

When the assembly 120 leaves the casing 111, following loading by the impeller 112, the displacement of the slide 160 allows the alignment of an ignition transmission pad with the block 121 of IR composition.

The infrared composition 121 is then ignited.

Depending on the nature and the thickness of the sheath 130, this is either destroyed or displaced relative to the slab 121 so that the desired infrared radiation is obtained in full.

It will be noted on examining FIG. 2 that the slab 121 is preferably longitudinally grooved to ensure channeling of the initiation gases and provide for igniting the slab 121 over its entire length.

More precisely, according to the particular embodiment illustrated in FIG. 2, the slab 121 is provided with a series of grooves 122 on two opposite faces, for example 3 grooves 122 on respectively each of two opposite faces.

According to the variant illustrated in FIG. 3, the slab 121 is provided with one or more grooves 122 on each of its four faces.

The sheath 130 is preferably formed from polystyrene, ABS (acrylonitrile butadiene styrene), polypropylene, polyethylene or PA6.6 (polyamide 6.6).

More precisely, according to the invention the material composing the sheath 130 is advantageously transparent to ultraviolet (UV) to allow the application of ultraviolet radiation through the sheath so as to ensure polymerization of a glue allowing the attachment of the sheath to the body 150 of the pyrotechnic initiation portion and/or the plug 140.

As previously indicated, according to the invention the sheath 130 is preferably formed of a rectilinear tube with a straight constant section the side wall whereof is continuous, solid, and without openings other than its axial through ends.

Shown in the appended figures are sheaths 130 formed from a rectilinear tube with a straight constant square section. Consequently the slab 121 has an identical geometry, homothetic in dimensions to define sufficient clearance to allow the insertion of the slab 121 into the sheath 130.

The use of a sheath made of plastic material with a square section has proven more reliable than coiling a film of aluminium on a square section charge. In fact, coiling the film of aluminium has weaknesses at the corners of the square section which a sheath formed for example by extrusion, molding or blowing does not have.

Of course the invention is not limited to this embodiment. It is possible to contemplate constructing sheaths 130 having any other section, for example a different straight polygonal, or circular section.

Moreover, it is possible to accomplish sheaths 130 having a variable thickness over their length to control the rising radiation front and its reproducibility.

A person skilled in the art will easily understand that the use of a sheath made of plastic material, for example by molding or extrusion, makes it possible to avoid any risk of tearing and allows a reduction in the cost of production with respect to the state of the art.

According to another advantageous feature of the present invention, the sheath 130 is made of an optically transparent material, at least in the infrared range and in the ultraviolet range. Thus the sheath does not perturb at all the transmission of infrared radiation emitted by the slab 121.

Test carried out by the inventors have in fact demonstrated that the use of a sheath 130 made of material transparent to infrared does not at all perturb the transmission of infrared radiation, whether in the power increase phase or in the steady regime of emission, this independent of the behavior of the sheath 130, that is whether the sheath 130 is ejected or destroyed by explosion.

Moreover, the inventors have determined that it is advantageous to provide for clearance, for example 0.5 mm between the slab 121 and the sheath 130. Thus the device conforming to the invention allows without risk a certain swelling of the slab 121, possibly under the influence of aging or climatic conditions. In this regard, the use of a sheath 130 made of plastic material is an important advantage with respect to the prior art using an envelope made of aluminium, to the extent that such an envelope made of aluminium will tolerate practically no swelling of the slab 121, and tears during the first deformations of the slab 121.

Shown in FIG. 5 is a variant of implementation according to which the closure plug 140 is made in a single piece with the sheath 130. Such a sheath 130 integrating the plug 140 can for example be formed by blowing.

Shown in FIG. 4 is a variant of implementation of the sheath 130 including a series of grooves on its outer surface to facilitate the bursting of the sheath under the pressure of the gases generated by the slab 121.

Numerous groove configurations can be provided for to this end.

According to the particular embodiment illustrated in FIG. 4, which is not limiting, the sheath 130 comprises a longitudinal groove 132 on each of its faces, for example at midwidth, and a series of transverse grooves 134. A person skilled in the art will understand that the presence of grooves 132 and 134 forming rupture initiators makes it possible to facilitate the cutting of the sheath 130 into segments of small dimensions and thus the bursting of the sheath 130.

Shown in FIGS. 6, 7, 8, and 9 are a particular embodiment of the body 150 of the pyrotechnic initiation portion and of the plug 140, adapted to facilitate the gluing of said bodies 150 and plug 140 to the sheath 130.

Figure 6:
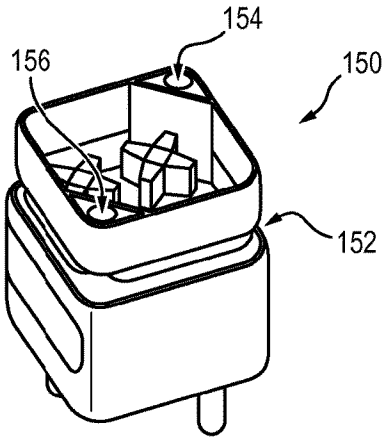
Figure 7:
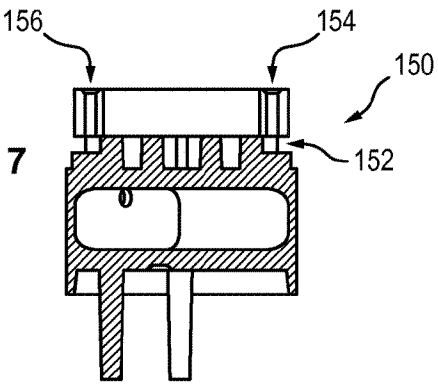

More precisely, according to the embodiment illustrated in FIGS. 6 and 7, the body 150 has an annular recess 152 which leads over the entire outer periphery and which communicates with two longitudinal channels 154, 156 which themselves lead to the end of the body 150 intended to be placed inside the sheath 130.

Figure 8:
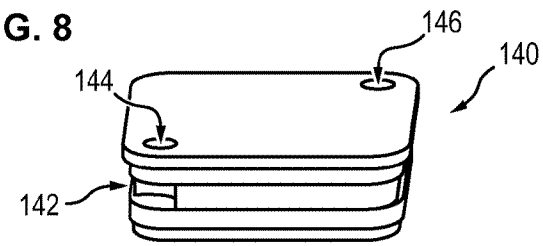
Figure 9:
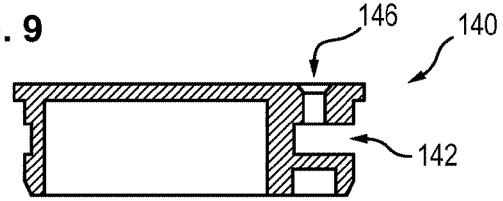

Likewise, according to the embodiment illustrated in FIGS. 8 and 9, the plug 140 has an annular recess 142 which leads to all of its outer periphery and which communicates with two longitudinal channels 144 146 which themselves lead to the end of the plug 140 intended to be placed outside the sheath 130.

During assembly, the body 150 is introduced into the sheath 130. A polymerizable glue is introduced into the channels 154 and 156 thanks to a tool engaged in the sheath 130, so as to fill the recess 152. Thus the ribbon of glue contained in the recess 152 comes into contact with the inner surface of the sheath 130. The glue can be polymerized at this stage of assembly or later, for example by UV irradiation through the sheath 130.

Once the assembly 120 comprising the slab 121 is place in the sheath 130, the plug 140 can be installed on the end of the sheath 130. Similarly to the operation accomplished for the body 150, a polymerizable glue is introduced into the channels 144 and 146 accessible from the outside, thanks to an appropriate tool, so as to fill the recess 142. Thus the ribbon of glue contained in the recess 142 comes into contact with the inner surface of the sheath 130. The glue can be polymerized at this stage of assembly or later, for example by UV irradiation through the sheath 130.

A person skilled in the art will understand that the means of gluing the body 150 and the plug 140 described above with regard to FIGS. 6 to 9 allow simple, economical and reliable assembly.

These means are particularly suited to a sheath 130 made of ABS (acrylonitrile butadiene styrene), even though the invention is not limited to the use of this particular material.

The polymerizable glue used within the scope of the present invention can be subject to numerous variants.

By way of a non-limiting example, it can be VITRALIT®, particularly VITRALIT® UV 4050 which is an acrylatebased glue.

As a variant, the body 150 and/or the plug 140 can comprise only a single longitudinal channel 154 or 156, respectively 144, 146.

The tests carried out have shown that the aforementioned means allow good mechanical strength of the assembly under the accelerations applied during launching and particularly that the application of UV radiation to ensure polymerization of the glue does not alter the mechanical and optical properties of the sheath 130. Thus the invention makes it possible to provide a sealing ring and mechanical strength ensuring safety and allowing the pressurization of the slab during operation.

By way of a non-limiting example, the sheath 130 can have a thickness on the order of 0.5 to 0.9 mm.

A first technical effect obtained according to the invention is the improvement of safety with respect to earlier aluminium envelopes due to the elimination of the risk of tearing prior to initiation.

A second technical effect obtained according to the invention results from the clearance allowed according to the invention, and prohibited by the earlier coiling technique, which allow swelling over time of the IR composition.

A third technical effect obtained according to the invention results from the mechanical confinement of the slab 121 caused by the sheath 130 and impossible with an envelope made of coiled aluminium paper once the applied forces applied by the slab 121 exceed a certain threshold.

Tests carried out by the inventors have also demonstrated that the use of a sheath 130 made of plastic material is totally compatible with the pyrotechnic environment involved and in particular that the use of such a sheath 130 made of plastic material does not risk leading to a level of electrostatic charge likely to induce an untimely initiation of the elements or pyrotechnic compositions used in the device.

Moreover, the sheath 130 made of plastic material masks the flame of the infrared slab 121 less than traditional aluminium paper. In fact, due to its mechanical strength under pressure at more than one bar, the sheath 130 separates or bursts more easily than a smear of aluminium which is glued to the slab 121 and which has a tendency to remain glued to this slab 121. The positive consequence resulting from the invention is better control of ignition and better reproducibility of ignition.

Of course, the present invention is not limited to the embodiments described previously, but extends to any variant conforming to its spirit.

The invention claimed is:

1. A device forming an infrared decoy comprising:

a triggering pyrotechnic portion (150), a composition (121) adapted to emit radiation in an infrared range, and an envelope (130) for protecting the composition (121), formed from a sheath made of plastic material, characterized in that one at least of a body (150) of a pyrotechnic initiation portion and/or a plug (140) for blocking the sheath (130) has an annular recess (152, 142) which leads to an outer periphery and which communicates with at least one longitudinal channel (154, 156; 144, 146), which leads to one end of the body (150) or the plug (140) to receive a ribbon of polymerizable glue providing for gluing the body (150) and/or the plug (140) to the sheath (130).

2. The device according to claim 1, characterized in that the envelope (130) is a rigid profiled envelope formed by extrusion, molding or blowing.

3. The device according to claim 1, characterized in that the envelope (130) is made of a material chosen among the group comprising polystyrene, ABS (acrylonitrile butadiene styrene), polypropylene, polyethylene or PA6.6 (polyamide 6.6).

4. The device according to claim 1, characterized in that the envelope (130) is made of an optically transparent plastic material, at least in the infrared range.

5. The device according to claim 1, characterized in that the envelope (130) is made of an optically transparent plastic material, at least in an ultraviolet range.

6. The device according to claim 1, characterized in that the envelope (130) defines a clearance of 0.5 mm around the composition (121).

7. The device according to claim 1, characterized in that the envelope (121) is made in one piece with a closure plug (140).

8. The device according to claim 1, characterized in that the envelope (130) has a variable thickness.

9. The device according to claim 1, characterized in that the envelope (130) has a thickness of 0.5 to 0.9 mm.

10. The device according to claim 1, characterized in that the sheath (130) comprises a series of grooves (132, 134) forming rupture initiators on its outer surface.

11. The device according to claim 1, characterized in that the composition (121) is longitudinally grooved to ensure channeling of initiation gases.

12. The device according to claim 1, characterized in that the sheath (130) has a straight square section.

* * * * *